US005902463A

United States Patent [19]

Terrase

[11] Patent Number: 5,902,463

[45] Date of Patent: May 11, 1999

[54] SUBMERSIBLE ANODE AND METHOD

[75] Inventor: Leon J. Terrase, Gretna, La.

[73] Assignee: Corrpro Companies, Inc., Medina, Ohio

[21] Appl. No.: 09/000,740

[22] Filed: Dec. 30, 1997

Related U.S. Application Data

[XX .
[60] Provisional application No. 60/034,907, Jan. 7, 1997.

[51] Int. Cl.[6] ..... C23F 13/00

[52] U.S. Cl. ..... 204/196.17; 204/196.21; 204/196.3; 204/196.31; 204/280; 204/297 R; 204/297 W; 204/286

[58] Field of Search ..... 204/297 R, 297 W, 204/286, 196.17, 196.3, 196.31, 196.21, 280

[56] References Cited

U.S. PATENT DOCUMENTS 3,803,012 4/1974 Kurr ..... 204/196.17
4,284,488 8/1981 Brittain et al. ..... 204/196.21
4,309,263 1/1982 Boyd ..... 204/196.21
4,484,840 11/1984 Nandlal et al. ..... 204/196.17

*Primary Examiner*—Bruce F. Bell
*Attorney, Agent, or Firm*—Renner, Otto, Boisselle, Sklar

[57] ABSTRACT

An anode and mounting bracket assembly is designed to seat quickly and easily on cylindrical or tubular underwater structures. The anodes span between end plates which include notches or recesses in which the tubular structure seats. The recesses include bell-mouth openings for ease of positioning. Each plate includes a pivoting gate including a saddle receiving the structure. Each plate also includes pointed bolts aimed over-center the gate pivots. When the brackets are positioned on the tubular structure the gates swing to a closed or locked position, the tightening of the bolts locks the gates closed. In such locked over-center position the gates block the bell-mouth openings of the plate recesses. The pointed bolts provide good electrical contact and the assembly may be easily removed by loosening the bolts to clear the gates. The assembly is then pulled from the structure.

13 Claims, 1 Drawing Sheet

SUBMERSIBLE ANODE AND METHOD

This application claims the benefit of U.S. Provisional Application No. 60/034,907, filed Jan. 7, 1997.

DISCLOSURE

This invention relates generally to a submersible anode and method, and more particularly to an anode incorporating a bracket which can readily be attached to and removed from underwater structures.

BACKGROUND OF THE INVENTION

Galvanic or sacrificial anodes are widely used for cathodic corrosion protection of underwater structures. Such sacrificial anodes create the galvanic current which protects the submerged structure, and are designed to corrode sacrificially. They accordingly must be properly electrically connected to the structure and replaced at the end of their design life. Submerged structures such as pipelines, offshore platforms, piers, pilings, or marine risers, can be very deep, and such anodes are normally installed by divers, submersibles or remotely operated vehicles. Divers, submersibles, such as manned submarines, or sophisticated remotely controlled robotic submersibles are extremely expensive to operate, and this is particularly true as the depth increases. The latter systems use robotic arms and even a diver has less than normal dexterity, particularly in a diving suit at significant depth. Such restraints also make many tools or power tools difficult to use.

In addition to the constraints of the submersible, or vehicle, environmental factors such as currents, visibility, bottom condition or bottom changes, bottom time, and many other factors, all make the placement and replacement of anodes difficult.

Many such submerged structures are cylindrical, such as tubular pilings or risers, the legs or braces of a platform, or the pipeline itself. The diameter of the tubular structures may vary widely as well as the orientation. Such structure near the bottom may have limited access due to sediment build up. Thus the complete surface may not be exposed or available for the mounting or replacement of an anode.

Accordingly, to address these concerns, it would be desirable to have an anode and bracket assembly mounting system which will quickly lock onto a cylindrical or tubular structure in a centralized and proper position, usually parallel to the axis of the structure and spaced from the surface, while at the same time making a reliable low resistance electric contact with the structure. It is also desirable to have an anode and bracket assembly mounting system which can as easily be removed from the structure.

SUMMARY OF THE INVENTION

An anode and bracket assembly for tubular or cylindrical submerged structures utilizes parallel spaced C-shape end plates with the anode or anodes extending between the plates. The anode or anodes may be cast on one or more rods extending between the plates and one may include a projecting handle to serve both for manual manipulation and as a lifting eye for hoisting, for attachment of buoyancy or floatation devices and for general positioning and transport of the assembly.

Each end plate includes an identical center opening or slot with a bell-mouth entrance. A locking gate is pivoted on each plate adjacent the entrance between stops. Each gate includes a structure seat notch or saddle. Each plate includes a threaded sleeve or coupling nut receiving a pointed contact bolt driven by a Tee handle. The bolt is aimed at the center of the structure when received in the slot but is aimed over-center the pivot of the locking gate. A line drawn from the tip of the bolt through the center of the structure forms an angle with the locking gate pivot greater than 180° so that advancing the bolt forces the structure to the bottom of the notch on the gate and toward the bottom of the opening or slot on the plate pivoting the gate to a closed and locked condition against a stop. In this manner, the pointed bolts firmly clamp the assembly to the structure with the cylindrical surface seated in both the bottom of the center opening or slot of each plate, and also the notch or saddle of each locking gate with the gate in the closed or locked condition. In the locked condition the gate blocks the bell-mouth opening of the slot. The pointed bolts when tightened provide good electrical contact between the anodes and structure. The assembly may as easily be removed by backing off or loosening the bolts so the tips clear the gate. The assembly is then simply pulled from the structure with the gates swinging to the open position.

To the accomplishment of the foregoing and related ends, the invention then comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
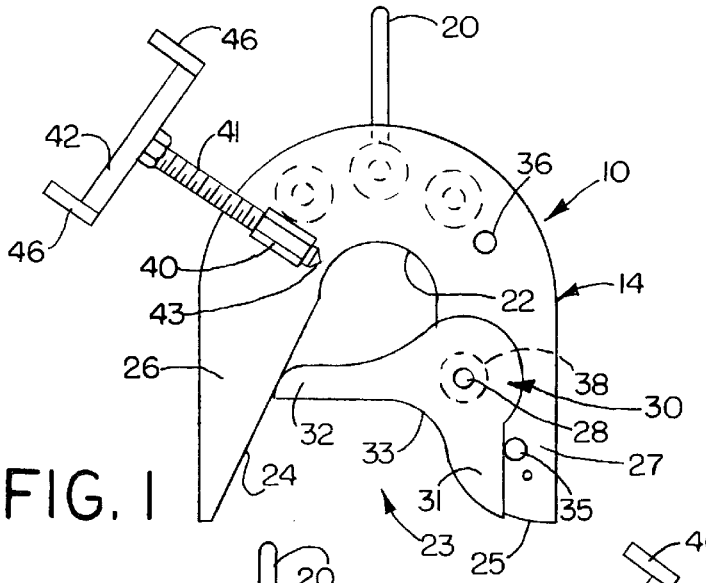
FIG. 1 is an end elevation of the anode bracket assembly with the gate in an unlocked or open position and the pointed bolt retracted.
Figure 2:
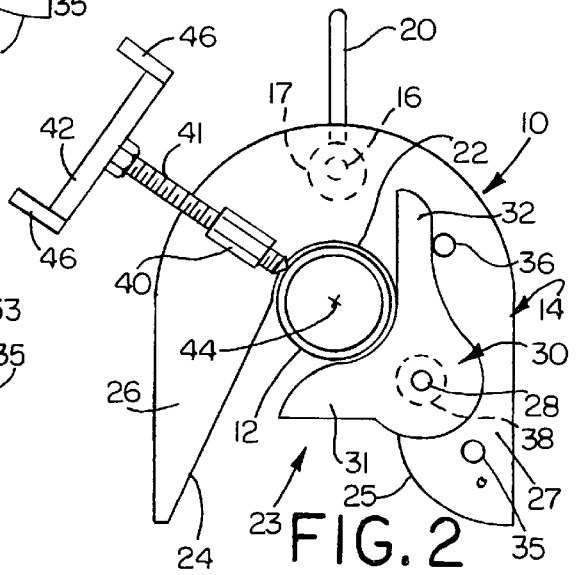
FIG. 2 is a similar view with the assembly on the structure, the gate closed and locked, and the pointed bolt tightened.
Figure 3:
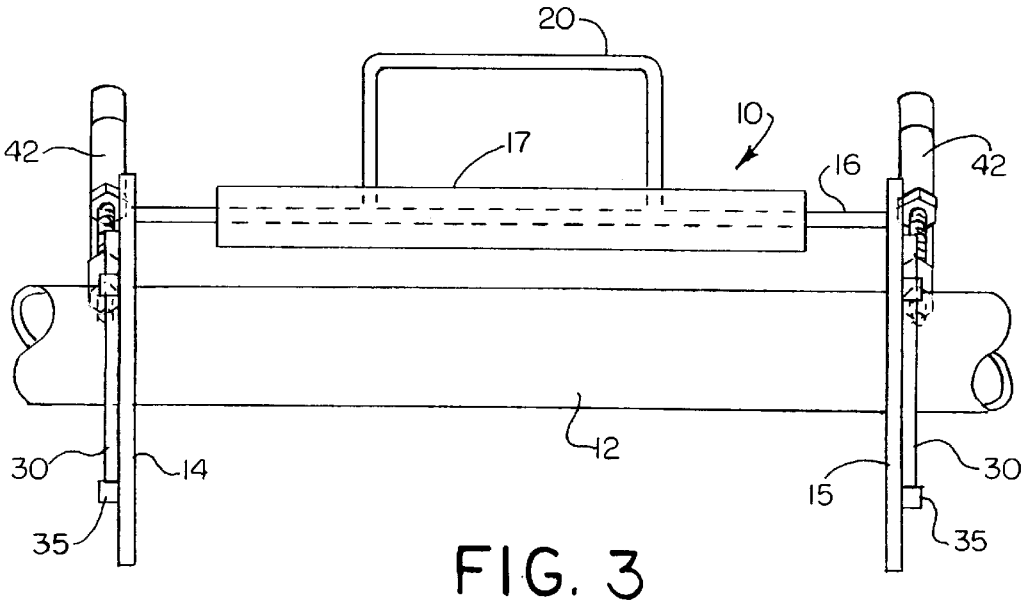
FIG. 3 is a side elevation as seen from the right hand side of FIG. 2.

Referring initially to FIGS. 1 through 3 there is illustrated an anode bracket assembly shown generally at 10 which is adapted to be mounted quickly and easily on an underwater structure shown generally at 12 in the form of a circular cylindrical tubular structure.

The anode bracket assembly can include C-shape end plates 14 and 15 which may be interconnected by rods 16 on which anodes 17 are cast. As illustrated in FIG. 1, there may be three such anodes and rods spanning the end plates. The anodes may be, for example, aluminum, magnesium or other anodic alloy. The number of anodes may vary from one to more than the three illustrated. In any event, the center anode is provided with a projecting handle seen at 20. Depending on the size and weight of the assembly, the handle may be utilized to grip the assembly manually, or it may be used to attach floatation devices, hoists, or mechanical manipulation devices, or a combination thereof. The handle in any event facilitates the transport and positioning of the device.

As seen more clearly in FIGS. 1 and 2, each end plate includes a center opening or notch 22 which has a downwardly opening bell mouth shown generally at 23 formed by the diverging interior sides 24 and 25. The two C-shape plates may be identical. Such plates may be positioned with the legs 26 and 27 forming the C facing downwardly.

Pivoted to each leg 27 on the exterior thereof at 28 is a locking gate 30. Each gate includes two arms shown generally at 31 and 32, the latter being somewhat longer. Between the arms the locking gate includes a saddle surface shown at 33 which generally conforms to the exterior of the structure 12. The locking gate is adapted to move between stops seen at 35 and 36 which engage the exterior of the respective gate arms. In the position of the gate seen in FIG. 1 the longer arm 32 extends across the bell mouth opening, while in the position of FIG. 2 the shorter arm locks the bell mouth opening. The gate is accordingly mounted for movement between the position seen in FIG. 1 and the position seen in FIG. 2. A washer indicated at 38 may be provided between the plate and the gate to protect the pivot from corrosion.

Mounted on the exterior of each plate is a threaded coupling nut 40 which receives threaded pointed bolt 41 having a Tee drive head 42. The nut is arranged so that the point of the bolt seen at 43 is aimed at approximately the center 44 of the structure 12 when seated in the notch 22.

In operation, the gate will normally be in its position seen in FIG. 1 with the longer smaller arm 32 projecting across the bell mouth opening while the shorter heavier arm 31 is down and against the stop 35. The pointed bolt 41 will be retracted to provide clearance for the longer arm. The assembly is then manipulated to be positioned over the structure 12 and lowered or shoved into place. The bell mouth opening facilitates this positioning of the assembly over the tubular structure 12 and as the positioning is completed, the gate swings to the position seen in FIG. 2 as the structure seats in the notch 22. The gate can swing no further than the position seen in FIG. 2 because of the stop 36. At this point, the two pointed bolts are tightened by rotation utilizing the Tee drive heads. As indicated the pointed bolts are pointed at the center of the structure and the tightening of the bolts drives the structure against the saddle surface of the gate. Since the pivot 28 for the gate is slightly over-center the axis of the bolts, the tightening of the bolts will tend to rotate the gate in a clockwise direction as seen in FIG. 2 forcing the gate against the stop 36. A line drawn through the axis of the bolt and the center 44 extends substantially above the axis of pivot 28. Thus an over-center or toggle locking action is provided so that the tightening of the pointed bolts not only clamps the bracket assembly to the structure, but also provides good electrical contact between the bracket assembly and such structure.

It is noted that the Tee handles 42 are provided with end stops 46. These may be used to assist in maintaining engagement with the arm on a remotely operated vehicle or other underwater robotic apparatus. It will be appreciated that other types of drive heads may be provided on the pointed bolts such as a common hexagonal head.

Figure 4:
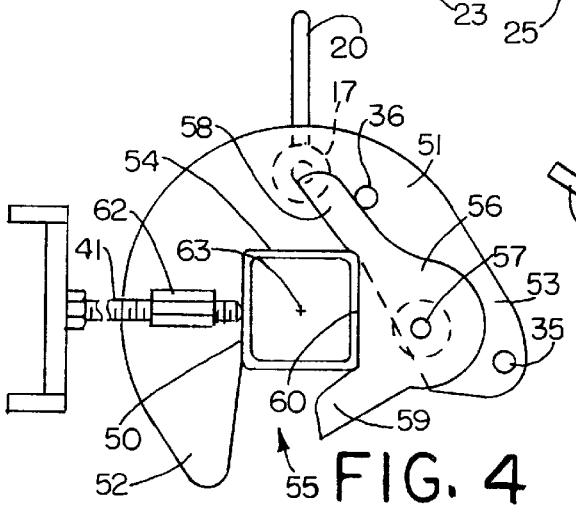
FIG. 4 is a view similar to FIG. 2 of an embodiment of the invention for non-circular tubular structures.

Although the embodiment of FIGS. 1 through 3 is designed to fit a circular cylindrical underwater structure, it will be appreciated that the invention may readily be applied to non-circular cylindrical underwater structures such as rectangular or square tubes. FIG. 4 illustrates a slight modification of the configuration of the end plates to accommodate such rectangular tubing shown generally at 50. The C-shape end plates 51 include legs 52 and 53 forming a notch 54 having a bell mouth opening 55 accommodating the structure 50.

The gate 56 is pivoted at 57 and includes two arms 58 and 59 having a saddle surface 60 therebetween which conforms generally to a wall of the structure 50. The pointed bolts 41 threaded in coupling nuts 62 are aimed at the centroid 63 of the structure 50 and the pivot 57 is considerably offset or below a line through the axis of the pointed bolts and the center of the structure 50. Thus the tightening of the bolts tends to pivot the gate in a clockwise direction as viewed in FIG. 4. In such locked condition illustrated, the arm 59 blocks the bell mouth opening 55. The assembly is otherwise the same and can as easily be positioned on the structure and locked in place. When the anode is ready for replacement, removal is as easy.

To the accomplishment of the foregoing and related ends, the invention then comprises the features particularly pointed out in the claims, these being indicative, however, of but a few of the various ways in which the principles of the invention may be employed.

I claim:

1. An anode bracket assembly of for tubular submerged structures comprising end plates with the anodes spanning the end plates, each plate including a notch adapted to fit over the structure, a gate pivoted to each plate adapted to swing from an open to a closed position, and a clamping bolt on an axis over-center the gate pivot to lock the gate in the closed position.

2. An anode bracket as set forth in claim 1 wherein said anode extends between said end plates and is parallel to yet spaced from said structure when said assembly is clamped to said structure.

3. An anode bracket as set forth in claim 1 wherein said structure is circular in section.

4. An anode bracket as set forth in claim 3 wherein said structure is rectangular in section.

5. An anode bracket as set forth in claim 1 wherein said gate includes a saddle surface embracing the structure.

6. An anode bracket as set forth in claim 1 wherein said notch generally conforms to the exterior of the structure.

7. An anode bracket as set forth in claim 1 wherein said clamping bolt is pointed and provides good electrical contact between the anode bracket and structure.

8. An anode bracket as set forth in claim 1 wherein said clamping bolt includes a Tee drive head.

9. An anode bracket as set forth in claim 1 wherein said end plates are generally C-shape and each notch includes a bell mouth.

10. A method of installing anodes on underwater structures comprising the steps of providing an anode bracket assembly having a notch with a bell-mouth opening adapted to receive the structure, pivoting a locking gate to a locking position as the structure enters the notch, and clamping the structure against the gate with an over-center force holding the gate in locked position.

11. A method as set forth in claim 10 including the step of clamping with pointed bolts to make good electrical contact between the anode and structure.

12. A method as set forth in claim 10 wherein said structure is circular in transverse section.

13. A method as set forth in claim 10 wherein said structure is rectangular in transverse section.

* * * * *